United States Patent [19]

Sayegh et al.

[11] Patent Number: 5,025,115

[45] Date of Patent: Jun. 18, 1991

[54] INSULATED POWER CABLES

[75] Inventors: Emile G. Sayegh; James G. Vana, Jr., both of Austin; Wendall D. Willey, Buda, all of Tex.

[73] Assignee: W. L. Gore & Associates, Inc., Newark, Del.

[21] Appl. No.: 526,918

[22] Filed: May 22, 1990

[51] Int. Cl.[5] ..... H01B 7/08

[52] U.S. Cl. ..... 174/117 F; 174/36; 174/117 FF

[58] Field of Search ..... 174/117 F, 117 FF, 36

[56] References Cited

U.S. PATENT DOCUMENTS

| | | | |
|---|---|---|---|
| 3,168,417 | 9/1963 | Smith, Jr. et al. | 428/383 |
| 3,352,714 | 3/1961 | Anderson et al. | 428/383 |
| 3,408,453 | 4/1967 | Shelton, Jr. | 174/258 |
| 3,733,428 | 5/1973 | Fry | 174/117 F X |
| 4,184,001 | 1/1980 | Hildreth | 428/383 |
| 4,440,973 | 4/1984 | Hawkins | 174/107 |
| 4,443,657 | 4/1984 | Hill et al. | 174/117 F X |
| 4,910,360 | 3/1990 | Lee | 174/117 F |
| 4,924,037 | 5/1990 | Ainsworth et al. | 174/117 F |

FOREIGN PATENT DOCUMENTS

| | | |
|---|---|---|
| 51-34227 | 3/1977 | Japan . |

*Primary Examiner*—Morris H. Nimmo

*Attorney, Agent, or Firm*—Gary A. Samuels

[57] ABSTRACT

A flat electrical power-carrying pod for inclusion as a component in a ribbon cable comprising a multiplicity of parallel wires insulated as a unit by polytetrafluoroethylene and having on each side of the plane of wires a layer of hard cut-through resistant film not contacting the other hard polymer layer. Polyimide is the preferred hard polymer.

8 Claims, 3 Drawing Sheets

INSULATED POWER CABLES

FIELD OF THE INVENTION

The invention relates to flat polytetrafluoroethylene ribbon cables which have a power pod as at least one component thereof.

BACKGROUND OF THE INVENTION

There is presently broad commercial use of flat ribbon cables embodying a wide assortment of sophisticated signal carrying, hook-up, and power wires and cables both mixed together or of one type only in the same flat cable. Pods of power-carrying wires are often a component of these cables with individual wires of the pod being insulated with polymer coverings or uninsulated and making electrical contact with each other in the bundle of power-carrying wires gathered together in the power pod. The advantages of having a flat ribbon cable lie in its characteristics of being thin and flexible. Any material layer added to the cable may decrease that thinness and/or flexibility and must offset that decrease with a commensurate advantage or gain in properties of the cable. One useful layer which may be added for its good physical and electrical properties and cut-through strength is a layer of a hard polymer such as a layer of polyimide film, which is wrapped around a wire, cable, or pod within the flat ribbon cable or a cut-through resistant polymer jacket extruded over the cable. Wrapping a power pod with a hard cut-through resistant polymer tape or extruding onto the cable a hard polymer jacket will, however, add a stiff relatively inflexible unit to the power pod.

SUMMARY OF THE INVENTION

The invention provides a flat generally planar multiwire power pod for inclusion as a component of a ribbon cable which comprises a multiplicity of uninsulated power conducting wires in generally parallel contact with each other along their length. The wires are insulated as a unit with polytetrafluoroethylene (PTFE) insulation. Imbedded in the PTFE insulation both above and below the plane of the power conducting wires are thin layers of hard cut-resistant insulation, preferably of fully cured polyimide film, which do not enter the web connecting the units comprising the flat cable. It is important to the proper functioning of the ribbon cable that the hard polymer layers do not continue past the power pods into the web of the cable where they can cause the webs to be stiffer and less flexible. The hard polymer layers may be coated or plated with a layer of electrically conductive metal so that the metallized polymer will serve to shield any signal-carrying components of the ribbon cable, or adjacent or nearby signal-carrying cables, from interfering radiation arising from the power pods. The metallized shield may also serve as a grounding drain wire.

The power pod, as well as the other components of the ribbon cable, is manufactured by layering together on a flat cabling device, such as those disclosed in U.S. Pat. Nos. 3,382,292 and 3,540,956, a layer of uninsulated electrical power conductors sandwiched between layers of porous PTFE and hard polymer or metallized hard polymer tape. The layered composite is passed through rollers under pressure that compress and tack unsintered PTFE tapes in the webs created by roller nips and then through a sintering oven having a temperature of at least 370° C. or a salt bath or other heating means for a specified time to sinter the porous PTFE and render the ribbon cable formed thereby non-porous. The porous PTFE preferred to make the ribbon cable is extruded PTFE tape or sheets formed by well known methods of extruding PTFE particles mixed with a hydrocarbon solvent as an extrusion paste.

DETAILED DESCRIPTION OF THE INVENTION

The invention is now described with reference to the drawings to more carefully and fully delineate the invention and its preferred embodiments.

Figure 1:
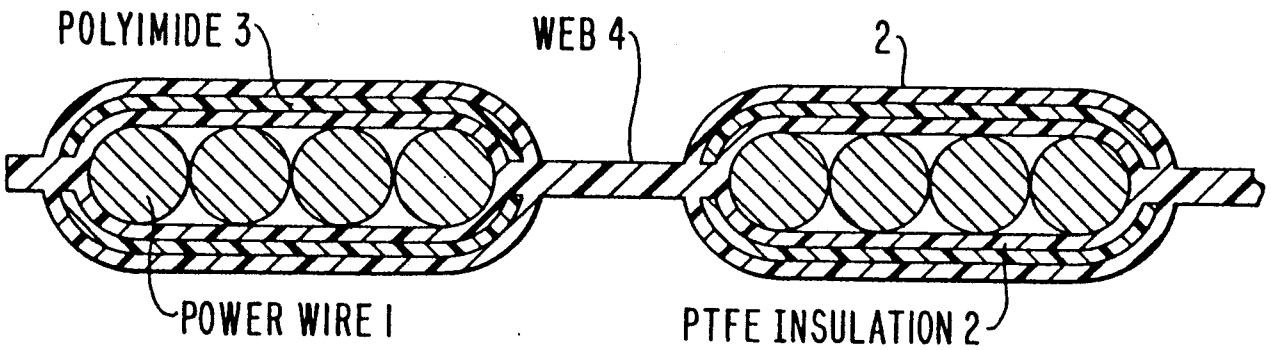
FIG. 1 shows a cross-sectional view of a pair of power pods of the invention.

FIG. 1 shows a cross-sectional view of a pair of power pods of the invention which are utilized in a flat ribbon cable which may also contain varying units of hook-up wire, coaxial signal cable, or other components which may find use in devices for deep oil and gas wells, communication satellites and other types of equipment for use in outer space or in planetary exploration and scientific measurement devices and for computers and communication devices of many varieties. The power-carrying wires 1 in electrical contact with each other along their axes and are surrounded by a layer of PTFE insulation which extends outwardly from power wires 1 to a web 4 of PTFE insulation which connects the power pod to an adjacent pod of the flat ribbon cable. The wires 1 in the pod are overlayed on both of the flat sides of the pod with a layer of hard cut-through resisting polymer, such as fully cured polyimide polymer layers 3. Kapton® polyimide films are useful materials for this layer and can be obtained commercially from E. I. du Pont de Nemours and Company. Polyimide layers 3 may be coated with a metal layer 5, such as that shown in FIG. 2, which will serve to shield to the inside of the power pod electromagnetic or radio frequency radiation which may be generated from power wires 1 and which could have a detrimental effect on any signals being carried by adJacent wires or cables housed in the flat ribbon cable or in another nearby cable. Polyimide layers may also be coated on one or both sides with high temperature adhesives, and per fluorinated ethylene propylene copolymer, perfluoroalkoxy tetrafluoroethylene, polyvinylidene fluoride, copolymer of ethylene and tetrafluoroethylene, or other thermoplastics. PTFE insulation 2 also covers the outside of the power pod.

Figure 2:
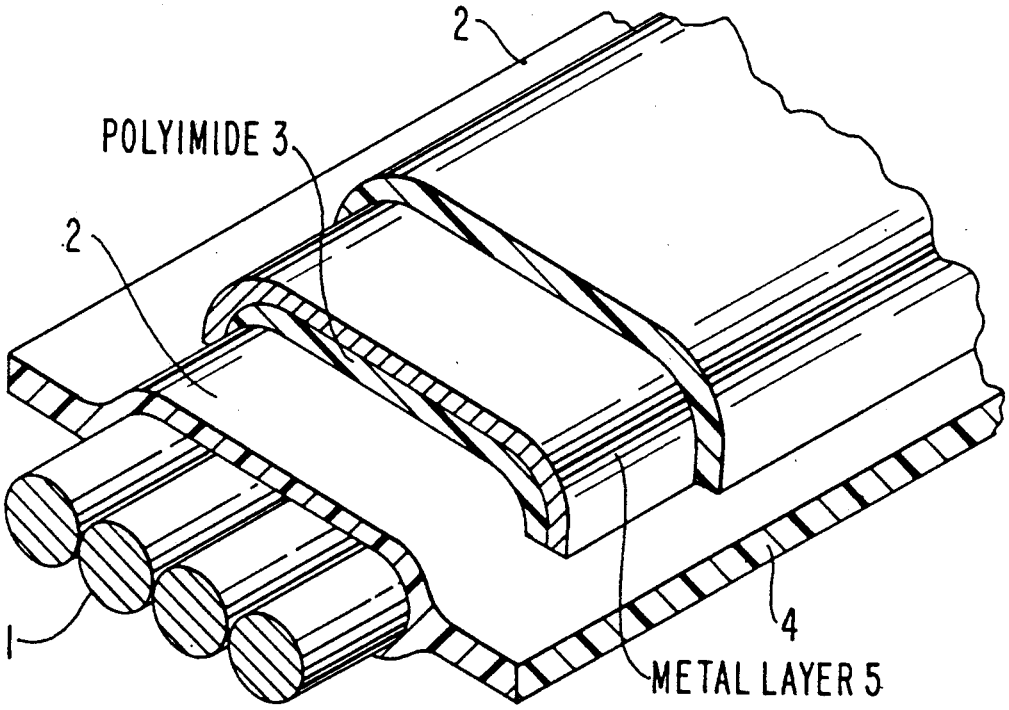
FIG. 2 describes in perspective cross-section a cable of the invention with exposed layers.

In FIG. 2, a cross-sectional perspective view of a power pod of the invention is described with the various layers of PTFE insulation 2, polyimide 3, and metal coating 5 peeled away to show their relationship to each other. Metal coating 5 on polyimide layer 3 may be any electrically conductive metal, but is preferably aluminum for these power pods. Polyimide layer 3 or aluminized polyimide layer, 5 and 3 taken together, do not completely encircle wires 3, there being always PTFE insulation 2 separating the edges of the polyimide and/or metal coated polyimide bands or strips and surrounding them on all sides. The polyimide tape is usually metallized before use in the process.

Figure 3:
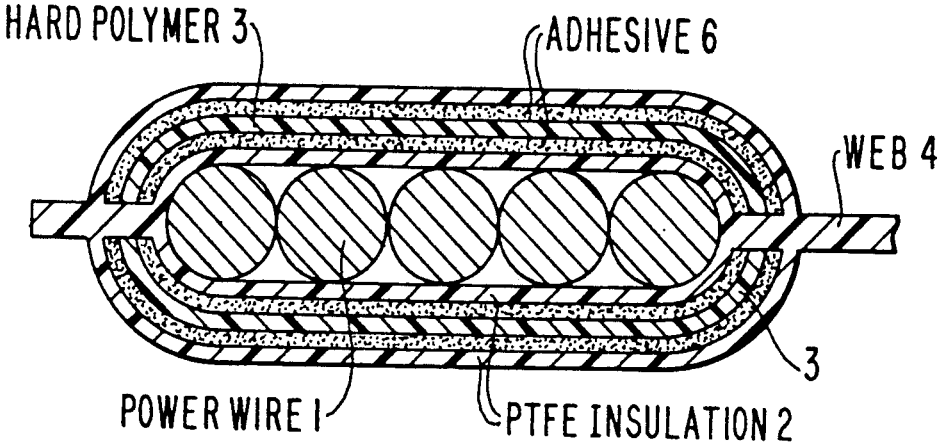
FIG. 3 discloses a cross-sectional view of a power pod of the invention in which the hard polymer layers are sandwiched on both sides with layers of adhesive.

FIG. 3 depicts in a cross-sectional view an alternative power pod of the invention in which hard polymer layer 3, usually polyimide, is surrounded on both sides by a layer of high-temperature thermoplastic adhesive 6, such as listed above, for example.

The power pods of the invention, as well as the remainder of the ribbon cable in which they are a component, are manufactured by standard flat ribbon cable processes, such as those described above, from porous unsintered PTFE strips or tape and polyimide tape or metallized tape and essentially comprise feeding together the layers in proper relationship into a system of pressure rollers, pressing the PTFE layers together, passing the formed layered flat cable into a sintering oven at above 370° C. for a time sufficient to cause complete sintering and fusion to full density of the PTFE insulation of the cable, and cooling the cable. Other heating means, such as ovens or infrared or microwave heating, may be used instead of a molten salt bath so long as full densification of the porous PTFE used to make the cable occurs.

Leaving webs filled with PTFE insulation between the edges of the hard polyimide tape in the power pod renders it less stiff and much more flexible than if the PTFE-insulated wires were wrapped with polyimide tape or metallized polyimide tape to provide the hard polymer and shielding layer. The webs are small such as 0.010 to 0.050 inch, but allow a more flexible power pod-containing flat ribbon cable having excellent shielding properties. The power pod of the invention is more flexible than an overall polyimide-insulated cable while providing the same cut-through protection and more flexible than a cable having an extruded jacket of cut-through resistant polymer, such as polyurethane or ethylene tetrafluoroethylene copolymer.

We claim:

1. A signal carrying flat ribbon cable having a flat, generally planar power pod as a component thereof, wherein the power pod comprises from inside to outside:

(a) a multiplicity of uninsulated electrically conducting wires arranged in generally parallel planar physical and electrical contact with one another along their axes surrounded by a first layer of polytetrafluororethylene insulation;

(b) a layer on each side of said multiplicity of generally parallel planar wires of a hard cut-through resistant polymer, said cut-through resistant polymer layers being separated from each other along their edges by polytetrafluororethylene insulation; and (c) a second layer of polytetrafluoroethylene insulation surrounding said cut-through resistant polymer layers, said wires, and said first layer of polytetrafluororethylene insulation surrounding said wires and including a web, said second layer of polytetrafluoroethylene insulation connecting said power pod to an adjacent component of said ribbon cable by means of the web.

2. A power pod of claim 1 wherein the polytetrafluoroethylene is porous polytetrafluoroethylene.

3. A power pod of claim 1 wherein said cut-through resistant polymer comprises polyimide polymer.

4. A power pod of claim 3 wherein said polyimide polymer is fully cured.

5. A power pod of claim 1 wherein at least one side of each layer of said cut-through resistant polymer is coated with a layer of adhesive.

6. A power pod of claim 1 wherein at least one of said cut-through resistant polymer layers is coated with a metal layer.

7. A power pod of claim 5 wherein said adhesive is a high-temperature resistant thermoplastic polymer.

8. A power pod of claim 7 wherein said thermoplastic polymer is selected from the group perfluorinated ethylene-propylene copolymer, perfluoroalkoxy tetrafluoroethylene, polyvinylidene fluoride, and copolymer of ethylene and tetrafluoroethylene.

* * * * *